United States Patent [19]

Sundeen

[11] 4,177,785

[45] Dec. 11, 1979

[54] DIESEL ENGINE GLOW PLUG ENERGIZATION CONTROL DEVICE

[75] Inventor: Arthur R. Sundeen, Lansing, Mich.

[73] Assignee: General Motors Corporation, Detroit, Mich.

[21] Appl. No.: 905,335

[22] Filed: May 12, 1978

Related U.S. Application Data

[63] Continuation-in-part of Ser. No. 846,917, Oct. 31, 1977, abandoned.

[51] Int. Cl.[2] ..... F02N 17/00

[52] U.S. Cl. ..... 123/179 H; 123/145 A; 123/179 B

[58] Field of Search ..... 123/145 A, 179 R, 179 B, 123/179 BG, 179 H

[56] References Cited

U.S. PATENT DOCUMENTS

| | | | |
|---|---|---|---|
| 2,487,924 | 11/1949 | Fiedler | 123/145 A |
| 2,552,256 | 5/1951 | Cerf | 123/179 B |
| 3,490,427 | 1/1970 | Welsh | 123/145 A |
| 3,551,686 | 12/1970 | Koehler | 123/179 B |
| 3,675,033 | 7/1972 | Richard et al. | 123/179 H |
| 4,075,998 | 2/1978 | Krauss et al. | 123/179 BG |
| 4,088,109 | 5/1978 | Woodruff et al. | 123/179 BG |
| 4,106,465 | 8/1978 | Bernhardt | 123/179 BG |

*Primary Examiner*—Charles J. Myhre
*Assistant Examiner*—David D. Reynolds
*Attorney, Agent, or Firm*—Richard G. Stahr

[57] ABSTRACT

A glow plug or plugs for a Diesel engine is energized directly or indirectly through the normally closed contacts of a thermally operated switch, preferably a bimetal switch, in thermal communication with the engine and a local electric heater that is energized by the same source as the glow plug and controlled in unison with the glow plug. The bimetal switch is arranged to switch off at a temperature of the order of 80° C. which, at an initial engine temperature of the order of −18° C., permits the glow plug to heat to the order of 900° C. The hysteresis in the bimetal switch is arranged to close the switch when the glow plug has cooled to the order of 810° C., thus the glow plug is cycled between the order of 800° C. and 900° C. It has been found that the glow plug temperature rise at elevated temperatures is substantially less than proportional to heat input. As a consequence, the effect of lower engine temperature is to produce increased glow plug temperature less than proportional to the bimetal temperature rise over engine temperature prior to switch opening, and the effect of increased engine temperature is to lower the glow plug temperature less than in proportion to the lesser bimetal temperature rise over engine temperature. With proper selection of the bimetal switch characteristics, the variation of glow plug temperature with engine temperature substantially matches the engine requirement for ease of start. Further, the glow plugs are initially heated at a very rapid rate and reach temperatures suitable for engine crank more quickly than with conventional, continuous, glow plug energization.

8 Claims, 7 Drawing Figures

DIESEL ENGINE GLOW PLUG ENERGIZATION CONTROL DEVICE

This application is a continuation-in-part of prior application Ser. No. 846,917, now abandoned filed Oct. 31, 1977.

BRIEF SUMMARY OF THE INVENTION

A glow plug or plugs for a Diesel engine is energized directly or indirectly through the normally closed contacts of a thermally operated switch, preferably a bimetal switch. The bimetal element is in thermal communication with the engine and is also heated by a local electric heater carrying a current from the same source as the glow plug. The local heater current goes on and off in unison with the glow plug energization. The bimetal switch is arranged to switch off at a temperature of the order of 80° C., and the local heater is arranged to heat the bimetal to this temperature when the initial engine temperature is of the order of −18° C. and the glow plug heats to the order of 900° C. The hysteresis in the bimetal switch is arranged under these conditions to close the switch when the glow plug has cooled to the order of 810° C., thus cycling the glow plug between the order of 800° C. and 900° C. after initial operation, when the engine temperature is about −18° C. It has been found that the glow plug temperature rise at elevated temperatures is substantially less than proportional to heat input. As a consequence, the effect of lower engine temperature is to produce increased glow plug temperature less than proportional to the bimetal temperature rise over engine temperature prior to switch opening, and the effect of increased engine temperature is to lower the glow plug temperature less than in proportion to the lesser bimetal temperature rise over engine temperature. It has been found that with proper selection of the bimetal switch opening temperature, such as of the order of 80° C. in the illustrative example, the variation of glow plug temperature with engine temperature substantially matches the engine requirement for ease of start. Further, the glow plugs are initially heated at a very rapid rate and reach temperatures suitable for engine crank more quickly than with conventional, continuous, glow plug energization.

This invention is directed to a Diesel engine glow plug energization control circuit and, more specifically, to a thermally operated Diesel engine glow plug energization control circuit which cyclically completes and interrupts a glow plug energizing circuit at a predetermined cycle period as determined by engine temperature.

To facilitate Diesel engine starting, expecially with cold ambient temperatures, electrically energized glow plugs which may be threaded into the engine block and include heater elements in communication with the combustion chamber are generally employed. Upon the electrical energization thereof, the heater elements are raised in temperature to preheat the combustion chamber prior to engine "Crank". The period of time of glow plug heater element energization prior to engine "Crank", the preheat period, is determined by engine temperature and glow plug heater element energizing potential magnitude, the lower the engine temperature and/or the lower the energizing potential magnitude, the longer the period of glow plug heater element energization. In prior art glow plug energization control systems, the glow plug heater elements are energized at rated energizing potential. Although this rated potential glow plug heater element energization prevents premature failure as a result of overheating, the period of preheat before engine "Crank" may be of the order of one of two minutes or more with colder ambient temperatures. To substantially reduce the period of preheat, the glow plug heater elements may be energized at greater than rated energizing potential. With glow plug heater energization greater than rated potential, however, to prevent glow plug destruction it is necessary that the heater elements be cyclically energized for successive periods of time just long enough to increase the temperature thereof to a predetermined maximum. Therefore, a Diesel engine glow plug energization control circuit which provides for a substantial reduction of the period of preheat before engine "Crank" by cyclically completing and interrupting the glow plug heater element energizing circuit through which the glow plug heater elements are energized at greater than rated operating potential, is desirable.

It is, therefore, an object of this invention to provide a Diesel engine glow plug energization control combination.

A more specific object of the present invention is to provide a Diesel engine glow plug energization control combination that advantageously utilizes the non-linear heating characteristic of the glow plug.

It is another object of this invention to provide an improved Diesel and engine glow plug energization control combination wherein a thermally operated electrical switching arrangement effects the cyclical energization and deenergization of the glow plugs at a cycle period determined by engine temperature.

It is another object of this invention to provide an improved Diesel engine and glow plug energization control combination that substantially reduces the preheat period by energizing the glow plug at current it cannot permanently withstand and cyclically completes and interrupts the glow plug heater circuit to avoid damage and wherein the actual temperature range of glow plug operation at least approximately matches the engine requirements.

It is another object of this invention to provide an improved Diesel engine and glow plug energization control combination wherein a thermally operated glow plug energization cycling arrangement is effective to complete a glow plug energization circuit across an operating potential source for a predetermined period of time as determined by engine temperature in response to the application of operating potential and, thereafter, is effective to cyclically interrupt and complete the glow plug energization circuit at a predetermind cycle period as determined by engine temperature.

For a better understanding of the present invention, together with additional objects, advantages and features thereof, reference is made to the following description and accompanying drawing in which.

Figure 1:
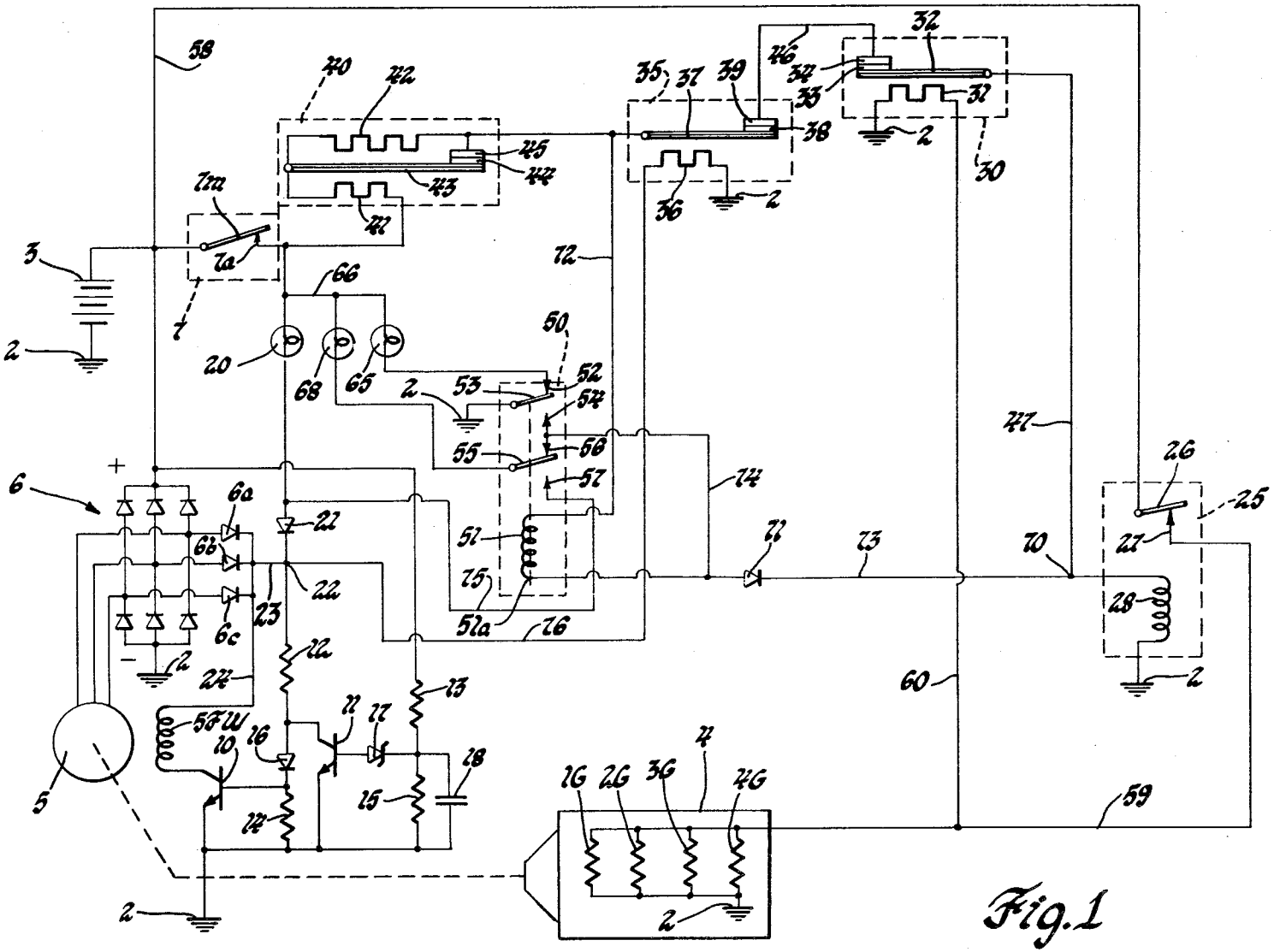
FIG. 1 is a circuit diagram of an illustrative Diesel engine glow plug energization control combination pursuant to this invention.

As point of reference or ground potential is the same point electrically throughout the combination, it is represented in FIG. 1 by the accepted schematic symbol and referenced by the numeral 2.

Referring to FIG. 1, the Diesel engine glow plug energization control combination of this invention is set forth in schematic form in combination with a source of operating potential, which may be a conventional automotive type storage battery 3, and a Diesel engine 4. The Diesel engine 4 is indicated as having four glow plugs 1G, 2G, 3G and 4G connected in parallel, each corresponding to a respective engine 4 combustion chamber. For purposes of this specification, the Diesel engine glow plug energization control combination of this invention will be described with regard to a 4-cylinder Diesel engine. It is to be specifically understood, however, that this combination is also applicable to Diesel engines having more or less cylinders.

Engine 4 is arranged to drive a conventional automotive type alternator 5 in a manner well known in the art. The three phase output potential of alternator 5 is full-wave rectified by a conventional six diode bridge-type full-wave rectifier circuit 6 well known in the art having a positive polarity output terminal connected to the positive polarity output terminal of battery 3 and a negative polarity output terminal connected to point of reference or ground potential 2.

The positive polarity output terminal of battery 3 is connected to the movable contact 7*m* of a conventional automotive type ignition switch 7 having in addition to movable contact 7*m* a stationary contact 7*a*. Movable contact 7*m* and stationary contact 7*a* may be the normally open ignition circuit contacts of a conventional automotive type ignition switch well known in the art or any other suitable single pole-single throw electrical switch.

Associated with full-wave rectifier circuit 6 is a diode trio 6*a*, 6*b* and 6*c* which provides the energizing current for alternator field winding 5FW through the current carrying electrodes of an NPN switching transistor 10 while this device is in the conductive mode. The circuitry including NPN switching transistor 10, NPN control transistor 11, resistors 12, 13, 14 and 15, diode 16, Zener diode 17 and filter capacitor 18 is a conventional voltage regulator circuit of a type well known in the art. Briefly, while the output potential of rectifier circuit 6 is less than a predetermined magnitude, Zener diode 17 remains in the blocking state to maintain control transistor 11 not conductive through the current carrying electrodes thereof. While control transistor 11 is not conductive, the potential across resistor 14 is of a magnitude sufficient to trigger switching transistor 10 conductive through the collector-emitter electrodes to complete an energizing circuit for field winding 5FW of alternator 5. Should the output potential of rectifier circuit 6 increase to a level substantially equal to or greater than the predetermined magnitude, Zener diode 17 breaks down and conducts in a reverse direction to trigger control transistor 11 conductive through the current carrying electrodes thereof. While control transistor 11 is conductive, base-emitter drive current is diverted from switching transistor 10 to extinguish this device which interrupts the alternator field coil 5FW energizing circuit.

Electric lamp 20 is the charge indicator lamp well known in the automotive art which illuminates while movable contact 7*m* of switch 7 is closed to stationary contact 7*a* and alternator 5 is not charging battery 3. Upon the closure of movable contact 7*m* of switch 7 to stationary contact 7*a* while alternator 5 is not charging battery 3, such as when engine 4 is not in the "Run" mode, an energizing circuit for charge indicator lamp 20 is provided and may be traced from the positive polarity output terminal of battery 3, through the closed contacts of switch 7, charge indicator lamp 20, diode 21, junction 22, leads 23 and 24, alternator field winding 5FW, the collector-emitter electrodes of switching transistor 10 and point of reference or ground potential 2 to the negative polarity output terminal of battery 3. Consequently, charge indicator lamp 20 becomes illuminated to indicate that alternator 5 is not charging battery 3. When engine 4 is cranked and begins to operate in the "Run" mode, the output potential of alternator 5 builds up, consequently, the potential upon junction 22 increases to a magnitude substantially equal to that upon the positive output terminal of full-wave rectifier circuit 6. This potential, applied to the cathode electrode of diode 21, reverse biases this device, consequently, charge indicator lamp 20 extinguishes to indicate that alternator 5 is charging battery 3. If desired, charge indicator lamp 20 may be fused.

An electrically controllable electrical power switching device, which may be a conventional electrical relay 25, is provided to complete and interrupt a glow plug energizing circuit when the movable contact 26 and stationary contact 27 thereof are operated electrically closed and open, respectively, upon the energization and deenergization, respectively, of operating coil 28. To effect the cyclical operation of the contacts 26 and 27 of relay 25, a thermally operated heater-bimetal glow plug energization cycling control combination 30 is provided. This control combination includes an electrically energized heater element 31 connected in an energizing circuit controlled by the contacts 26 and 27 of power switching relay 25, a bimetal element 32 located in heat transfer relationship with heater element 31 and normally closed electrical contacts 33 and 34. The glow plug energization cycling control combination 30 is operative to effect the operation of power switching relay 25 electrically closed upon the application of operating potential to complete the glow plug and heater element 31 energizing circuits for a predetermined period of time as determined by engine temperature and, thereafter, to effect the operation of power switching relay 25 alternately electrically open and closed at a predetermined cycle period as determined by engine temperature. Therefore, upon the application of operating potential, the glow plug and heater element 31 energizing circuits are initially completed for the predetermined period of time and, thereafter, are cyclically interrupted and completed at a frequency determined by engine temperature.

It has been determined that, as the glow plug temperature approaches a value of the order of 900° C. at which the combustible mixture injected into the engine combustion chamber is heated by the glow plug to a mixture-igniting temperature range, the glow plug is characterized by substantially decreased temperature rise per unit of input heating power. Therefore, any error in the control combination results in a lower error in glow plug temperature for the reason that the effect of lower engine temperature is to produce increased glow plug temperature less than proportional to the bimetal temperature rise over engine temperature prior to switch opening and the effect of increased engine temperature is to lower the glow plug temperature less than in proportion to the lesser bimetal temperature rise over engine temperature. Further, it has been found that with proper selection of the bimetal switch opening temperature, such as of the order of 80° C., the variation of glow plug temperature with engine temperature substantially matches the engine requirement for ease of start. Further, the glow plugs are initially heated at a very rapid rate and reach temperatures suitable for engine crank more quickly than with conventional, continuous, glow plug energization.

To function in the manner described in the preceding paragraph, the glow plug energization cycling control combination 30 is designed to be a thermal model of the engine glow plugs. That is, the glow plugs and the glow plug energization cycling control combination 30 must have equal dimensions of thermal time constant for the reason that the thermal characteristics of each must be matched to those of the other. In this regard, the thermal time constant value in seconds is equal to thermal mass divided by thermal conductivity, thermal mass is expressed as watt seconds per degree Celsius and thermal conductivity is expressed as watts per degree Celsius. As is well-known in the art, "time constant" is usually expressed in seconds and is the time required for a physical quantity to change its initial (zero-time) magnitude by the factor $(1-{}^{1}/\epsilon)$ when the physical quantity is varying as a function of time. As the hereinabove set forth factor has a fractional value of 0.632 after a time lapse of one time constant, starting at zero time, the magnitude of the physical quantity will have changed 63.2%. The combination of this invention operates only through a fractional portion of the first time constant. In an actual embodiment, the thermal time constant of the glow plugs and the glow plug energization cycling control combination 30 is approximately twenty-eight (28) seconds. The thermal time constant of the engine glow plugs is empirically determined while the glow plugs are installed in the engine. The glow plug energization cycling control combination 30 is then designed to have a thermal time constant substantially equal to that of the glow plugs. Further, the respective temperatures of the glow plugs and the glow plug energization cycling control combination 30 are scaled to each other over the lower temperature range of the glow plugs. The scaling factor varies over the higher temperature range of the glow plugs due to the non-linear temperature characteristic of the glow plug with input power. In the actual embodiment, the scaling factor at the lower glow plug temperature range is of the order of ten (10). That is, the glow plugs heat and cool ten times faster than does the glow plug energization cycling control combination 30 over the lower temperature range of the glow plug. Since the glow plugs are heated to temperatures as high as the order of 900° Celsius maximum in the actual embodiment, the maximum temperature to which the glow plug energization cycling control combination 30 is heated is scaled relative to that of the glow plugs over the lower temperature range of the glow plug. For example, the maximum temperature to which the glow plug energization cycling control combination 30 is heated in the actual embodiment is of the order of 80° Celsius.

As is well-known in the Diesel engine art, it is desirable to maintain glow plug energization for a predetermined period of time after engine "Start" and the engine is in the "Run" mode. This period of time is known in the art as the afterglow period and is provided in the circuit of FIG. 1 by a heater-bimetal afterglow combination 35 that includes an electrically energizable heater element 36, an associated bimetal element 37 in heat transfer relationship with heater element 36 and normally closed electrical contacts 38 and 39. The operation of this afterglow combination 35 will be explained in detail later in this specification.

In the event the circuit through which heater element 31 is energized should become open, there would be no provision for interrupting the glow plug energizing circuit, a condition which will result in the rapid destruction of the glow plugs. To avoid this possibility, a heater-bimetal failure mode combination 40 is provided. The failure mode combination 40 includes an electrically energizable heater element 41, an electrically energizable sustainer heater element 42, a bimetal element 43 in heater transfer relationship with heater elements 41 and 42 and normally closed electrical contacts 44 and 45. The operation of this failure mode combination 40 will be explained in detail later in this specification.

Upon the application of operating potential by closing movable contact *7m* of switch 7 into electrical circuit closing engagement with stationary contact *7a* as shown in FIG. 1, an energizing circuit is completed for operating coil 28 of power switching relay 25 which may be traced from the positive polarity output terminal of battery 3, through the closed contacts of switch 7, heater element 41 of the failure mode combination 40, bimetal element 43, closed contacts 44 and 45 which short-circuit sustainer heater element 42, lead 46, bimetal element 37 of the afterglow combination 35, closed contacts 38 and 39, closed contacts 33 and 34 of the glow plug energization cycling combination 30, bimetal element 32, lead 47, operating coil 28 of power switching relay 25 and point of reference or ground potential 2 to the negative polarity output terminal of battery 3. It may be noted that bimetal element 37 and closed contacts 38 and 39 of the afterglow combination 35 and closed contacts 33 and 34 and bimetal element 32 of the glow plug energization cycling control combination 30 substantially short-circuits the operating coil 51 of electrical relay 50, consequently, this device is unenergized at this time. Upon the energization of operating coil 28 of power switching relay 25, movable contact 26 is operated into electrical circuit closed engagement with stationary contact 27 as shown in FIG. 1 to complete an energizing circuit for the glow plugs 1G, 2G, 3G and 4G of engine 4 and heater element 31 of the glow plug energization cycling combination 30 and thereby initiate a glow plug heating cycle. The energizing circuit for the engine glow plugs may be traced from the positive polarity output terminal of battery 3 through lead 58, closed contacts 26 and 27 of power switching relay 25, lead 59, the four engine glow plugs in parallel and point of reference or ground potential 2 to the negative polarity output terminal of battery 3. The energizing circuit for heater element 31 may be traced from the positive polarity output terminal of battery 3, through lead 58, closed contacts 26 and 27 of power switching relay 25, leads 59 and 60, heater element 31 and point of reference or ground potential 2 to the negative polarity output terminal of battery 3. The energizing circuit for each the engine glow plugs and heater element 31 of the glow plug energization cycling control combination 30, therefore, are controlled by power switching relay 25.

As operating coil 51 of electrical relay 50 is not energized for the reason hereinabove set forth, upon the closure of movable contact *7m* of switch 7 to stationary contact *7a*, an energizing circuit for electric lamp 65 is completed and may be traced from the positive polarity output terminal of battery 3, through the closed contacts of switch 7, lead 66, indicator lamp 65, the closed contacts 52 and 53 of relay 50 and point of reference or ground potential 2 to the negative polarity output terminal of battery 3. Indicator lamp 65 may be mounted in the passenger compartment and, when illuminated, indicates to the operator that the engine should not be cranked for the reason that the engine glow plugs have not been heated to the temperature to which they should be heated before the engine should be cranked. Consequently, the operator should wait until this lamp extinguishes before attempting to crank the engine. This indicator lamp will hereinafter be referred to as the "Wait" indicator lamp. Indicator lamp 68 is not illuminated at this time for the reason that it is shunted by the heater element 41 and coil 51 as both electrical contact pairs 44–45 and 55–56 are electrically closed at this time.

Upon the completion of the glow plug and heater element 31 energizing circuits, the temperature of these elements begins to increase. As the thermal time constant of each the engine glow plugs and the glow plug energization cycling control combination 30 are designed to be substantially equal, the rate at which the glow plug energization cycling control combination 30 increases in temperature substantially tracks the rate at which the glow plugss increase in temperature. When the glow plug energization cycling control combination 30 has heated to a temperature corresponding to the maximum temperature to which the glow plugs should be heated, contacts 33 and 34 thereof are thermally operated open. In a manner to be explained in this specification, the heater element-bimetal element combinations 30, 35 and 40 are all mounted upon the associated Diesel engine in a location at which they are all influenced by engine temperature. Therefore, the period of time required for the glow plugs to heat to the maximum allowable temperature is inversely proportional to engine temperature. That is, the colder the engine temperature, the longer period of time required for the glow plugs to heat to the maximum allowable temperature.

Upon the thermal operation of contacts 33 and 34 electrically open, the previously described energizing circuit for operating coil 28 of power switching relay 25 is interrupted and the short-circuit across operating coil 51 of relay 50 is removed. Consequently, movable contact 26 of power switching relay 25 moves out of electrical circuit engagement with stationary contact 27 to interrupt the glow plug and heater element 31 energizing circuits and initiate a glow plug cooling cycle and operating coil 51 is energized through a circuit which may be traced from the positive polarity output terminal of battery 3, through the closed contacts of switch 7, heater element 41, bimetal element 43 and closed contacts 44 and 45 of failure mode combination 40, lead 72, operating coil 51, diode 71, lead 73, operating coil 28 of power switching relay 25 and point of reference or ground potential 2 to the negative polarity output terminal of battery 3. Operating coil 51 is selected to have an ohmic resistance of a value much greater than that of operating coil 28, for example of the order of fifteen times. Most of the battery 3 potential, therefore, is dropped across operating coil 51, consequently, operating coil 28 of power switching relay 25 is not energized to a level great enough to operate movable contact 26 thereof into electrical circuit engagement with stationary contact 27. In the actual embodiment, the resistance of operating coil 51 is forty-five ohms and the resistance of operating coil 28 is three ohms.

Upon the energization of operation coil 51 of relay 50, the gang-operated movable contacts 53 and 55 thereof are operated out of electrical circuit closing engagement with respective stationary contacts 52 and 56 and into electrical circuit closed engagement with respective stationary contacts 54 and 57. Upon the closure of movable contact 53 to stationary contact 54, the negative polarity output terminal of battery 3 is connected to terminal end 51*a* of operating coil 51 through lead 74, closed contacts 54 and 53 and point of reference or ground potential 2, consequently, relay 50 is held in this operating condition. Upon the operation of movable contact 55 into electrical circuit engagement with stationary contact 57 an energizing circuit is completed for indicator lamp 68 which may be traced from the positive polarity output terminal of battery 3, through the closed contacts of switch 7, lead 66, indicator lamp 68, closed contacts 55 and 57 of relay 50, lead 75, diode 21, junction 22, leads 23 and 24, alternator field winding 5FW, the collector-emitter electrodes of switching transistor 10 and point of reference or ground potential 2 to the negative polarity output terminal of battery 3. Indicator lamp 68 may be also located in the passenger compartment and, when illuminated, indicates to the operator that the glow plugs have been heated to a temperature high enough to permit the engine to be cranked. Indicator lamp 68 will hereinafter be referred to as the "Crank" indicator lamp.

Upon the interruption of the respective energizing circuits, the engine glow plugs and the glow plug energization cycling control combination 30 begin to cool and, since the thermal time constant of the glow plug energization cycling control combination 30 is designed to be substantially equal to that of the glow plugs, the rate at which the glow plug energization cycling control combination 30 cools substantially tracks that at which the glow plugs cool. At a lower predetermined temperature, contacts 33 and 34 of the glow plug energization cycling control combination 30 again close to complete the previously described energizing circuit for operating coil 28 of power switching relay 25. Even though substantially ground potential is present upon terminal end 51*a* of operating coil 51 of relay 50, it is isolated from operating coil 28 by diode 71. Upon the completion of the previously described energizing circuit, operating coil 28 is energized sufficiently to operate movable contact 26 into electrical circuit closing engagement with stationary contact 27 to again complete the previously described heater element 31 and glow plug energizing circuits and initiate another glow plug heating cycle. The lower predetermined temperature at which contacts 33 and 34 close is determined by the desired cycle period. The shortest cycle period consistent with satisfactory power switching relay life at the lowest probable engine temperature is determined. The rate of cooling of the glow plugs and the glow plug energization cycling control combination 30 at this engine temperature and the desired cycle period determines the lower temperature to which the glow plugs and the glow plug energization cycling control combination 30 cools before contacts 33 and 34 are closed. When the glow plugs have become heated to the maximum allowable temperature during this heat cycle, contacts 33 and 34 are thermally operated electrically open to interrupt the previously described operating coil energizing circuit to initiate another glow plug cooling cycle. Therefore, the glow plug and heater element 31 energizing circuits are cyclically interrupted and completed by power switching relay 25 at a frequency determined by engine temperature in response to the cyclical operation of the glow plug energization cycling control combination 30. It may be noted that as the engine temperature increases, the rate at which heat is dissipated from both the glow plugs and the glow plug energization cycling control combination 30 decreases, consequently, with increases of engine temperature, the cycle period also increases because a longer period of time is required for the glow plugs and the glow plug energization cycling control combination 30 to reduce to the lower predetermined temperature.

After the engine has been cranked and is in the "Run" mode, an output potential of a magnitude substantially equal to that of battery 3 appears upon junction 22. This potential is applied to the cathode electrode of diode 21 to reverse bias this device to extinguish charge indicator lamp 20 and "Crank" indicator lamp 68 and supplies energizing potential for heater element 36 of afterglow combination 35 through lead 76. The afterglow combination 35 is designed to have a thermal mass great enough to provide a predetermined period of glow plug afterglow, for example, two minutes at the lowest probable engine temperature. That is, at the lowest probable engine temperature, the afterglow combination 35 will heat to a temperature sufficiently great to operate contacts 38 and 39 thereof electrically open at the conclusion of the predetermined afterglow period. In the actual embodiment, heater element 36 has a resistance value of 115 ohms. As this combination is also sensitive to engine temperature, the higher the engine temperature the shorter will be this afterglow period. When contacts 38 and 39 have operated open, the energizing circuit through which operating coil 28 of power switching relay 25 is interrupted and is maintained interrupted while the engine is in the "Run" mode as energization potential is maintained upon heater element 36 while engine 4 is in the "Run" mode. Consequently, the circuit is maintained inactive.

The failure mode combination 40 is designed to have a thermal time constant substantially equal to that of the glow plug energization cycling control combination 30, however, the resistance value of heater element 41 is selected to be less than that of heater element 31 by an amount which will provide for the failure mode combination 40 being heated to a temperature great enough to open contacts 44 and 45 at a preselected time delay later than that at which contacts 33 and 34 of the glow plug energization cycling control combination 30 should have opened. In the actual embodiment, this delay period is approximately two seconds with heater element 41 having a resistance value of 0.45 ohms and heater element 31 having a resistance value of 30 ohms. Consequently, should the lead through which heater element 31 is energized become open, contacts 44 and 45 of the failure mode combination 35 would operate to the electrical circuit open condition in a predetermined period of time longer than that at which contacts 33 and 34 of the glow plug energization cycling control combination 30 would have opened had the energizing circuit for heater element 31 not been open. Upon the operation of contacts 44 and 45 electrically open, failure mode sustainer heater element 42 is connected in series with heater element and operating coil 28 of power switching relay 25. The resistance value of sustainer heater element 42 is selected to be great enough that most of the battery 3 potential is dropped across the series combination of heater elements 41 and 42, thereby leaving insufficient potential to energize operating coil 28 to a degree great enough to maintain movable contact 26 into electrical circuit engagement with stationary contact with contact 27. In the actual embodiment, sustainer heater element 42 has a resistance value of 32 ohms. Consequently, the contacts of power switching relay 25 operate open to interrupt the previously described glow plug energizing circuit. Therefore, the circuit is maintained inactive so long as operating potential is applied thereto through the closed contacts of switch 7.

In the event of a failure as hereinabove described, the potential drop across the series combination of heater elements 41 and 42 leaves insufficient battery 3 potential to energize operating coil 51 of relay 50 sufficiently to operate movable contacts 53 and 55 into engagement with respective stationary contacts 54 and 57. Consequently, an energizing circuit is completed for each "Crank" indicator lamp 68 and "Wait" indicator lamp 65. The energizing circuit for "Crank" indicator lamp 68 may be traced from the positive polarity terminal of battery 3, through the closed contacts of switch 7, lead 66, "Crank" indicator lamp 68, closed contacts 55 and 56 of relay 50, lead 74, diode 71, operating coil 28 of power switching relay 25 and point of reference or ground potential 2 to the negative polarity output terminal of battery 3. The energizing circuit for "Wait" indicator lamp 65 which may be traced from the positive polarity output terminal of battery 3 through the closed contacts of switch 7, lead 66, "Wait" indicator lamp 65, closed contacts 52 and 53 of relay 50 and point of reference or ground potential 2 to the negative polarity terminal of battery 3. With both the "Wait" indicator lamp 65 and the "Crank" indicator lamp 68 illuminated, the operator is informed that there is a system failure.

Figure 2:
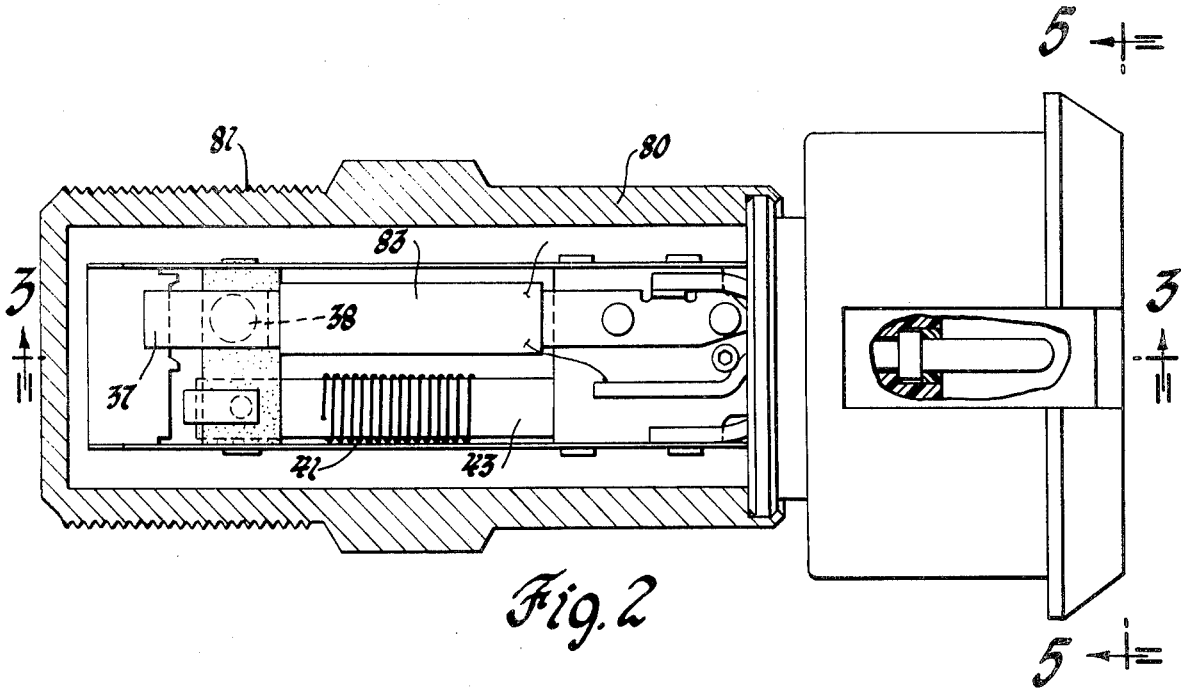
FIG. 2 is a top view of a thermostatic switch constructed in accordance with the present invention with the enclosure broken away.
Figure 3:
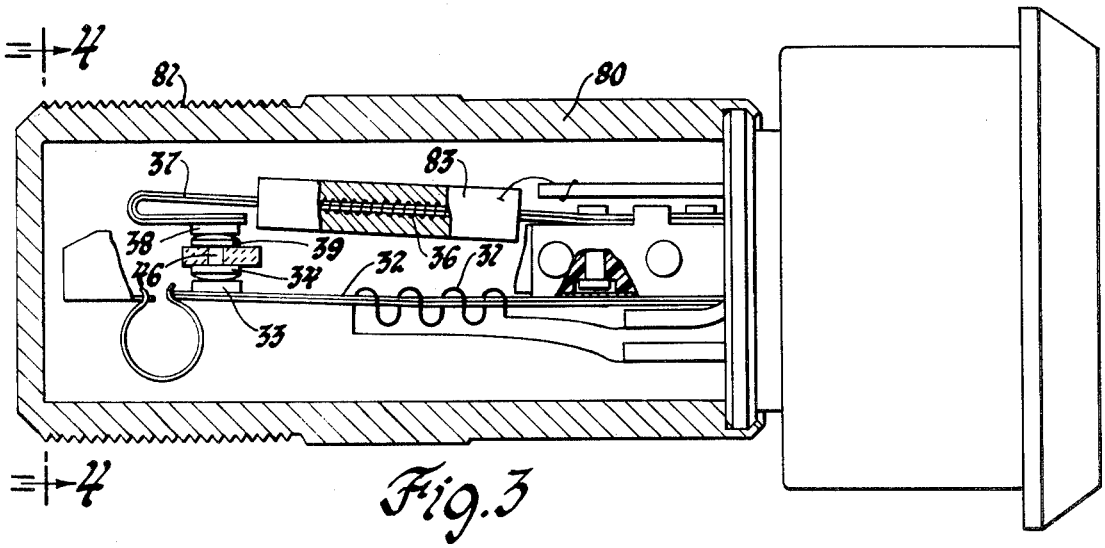
FIG. 3 is a partial section view of FIG. 2 taken along line 3—3 and looking in the direction of the arrows.
Figure 4:
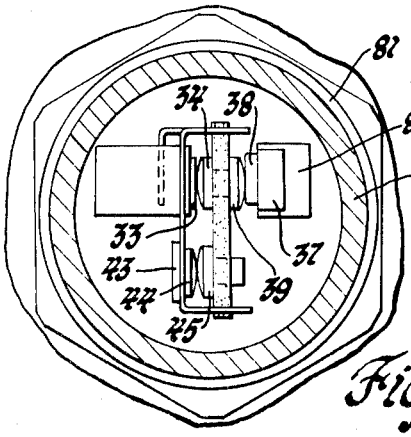
FIG. 4 is a section view of FIG. 3 taken along line 4—4 and looking in the direction of the arrows.
Figure 5:
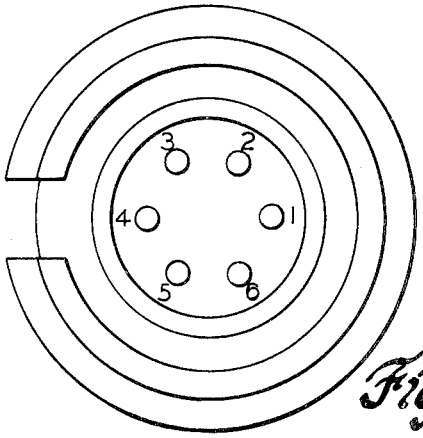
FIG. 5 is an end view of FIG. 2 looking in the direction of arrows 5—5.

In the actual embodiment of the control combination of this invention, the thermally operated glow plug energization cycling control combination 30, the afterglow combination 35 and the failure mode combination 40 of FIG. 1 were mounted in a metal enclosure as illustrated in FIGS. 2–5. The case member 80 is of brass or nickel plated steel and is provided with a ½–14 pipe thread 81 that is accommodated by a suitably threaded bore in the engine cooling liquid jacket whereby the three heater-bimetal element combinations mounted therein are sensitive to the temperature of the engine. Secured to the open end of case 80 is a six-male pin connector, as best seen in FIGS. 2 and 5, through which the proper electrical connections are made to the external circuitry. In FIGS. 2–4, the elements corresponding to the same elements of FIG. 1 are assigned like characters of reference. The element 83 of FIGS. 2 and 3 is a heat sink which provides for the predetermined afterglow. In this regard, heater element 41 is a flat conductive strip secured to the underside of bimetal 43 as viewing FIG. 2. Consequently, this heater element is not illustrated in FIG. 2.

Figure 6:
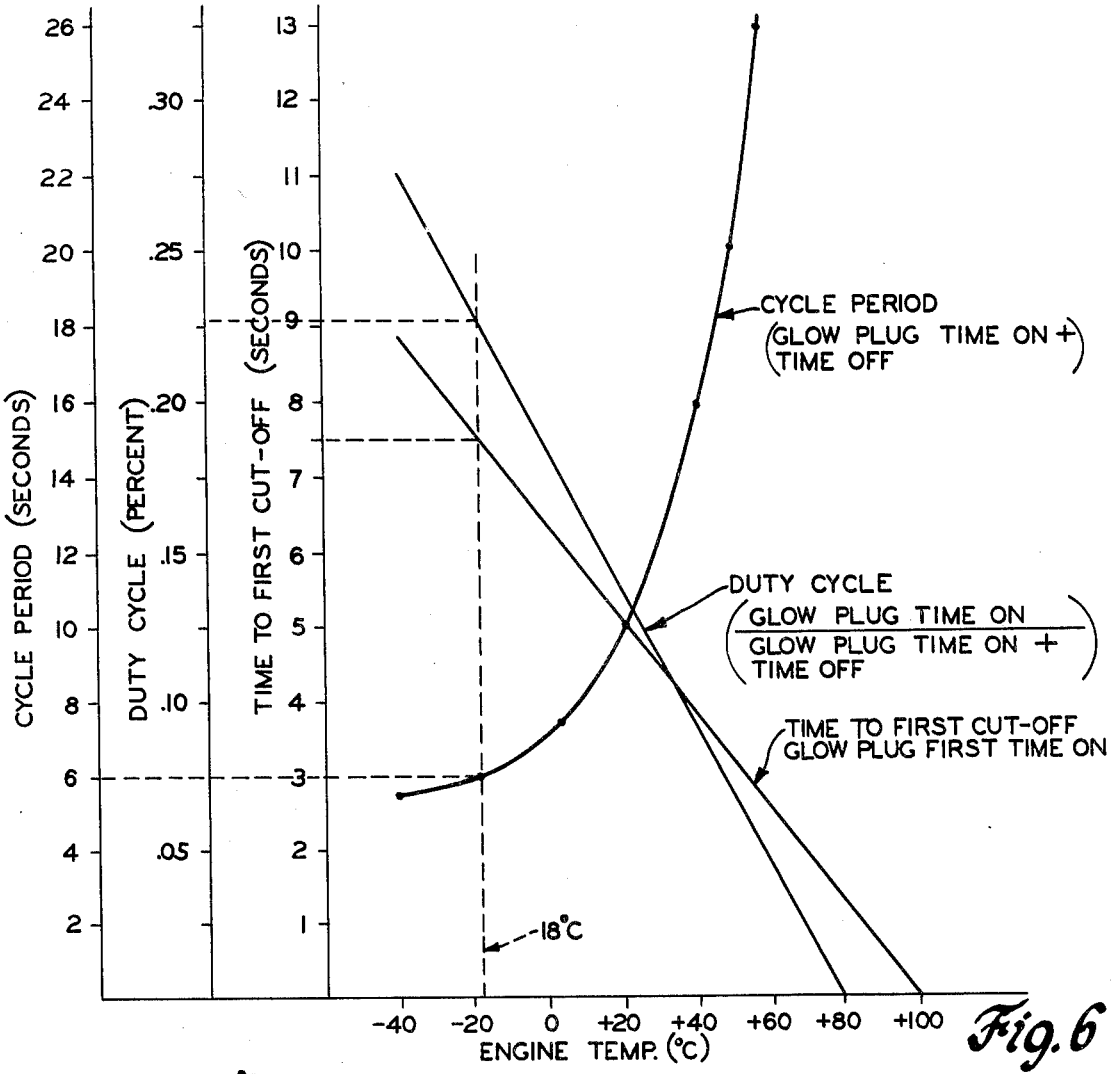
FIG. 6 is a set of curves useful in understanding the operation of the circuit of FIG. 1.

In the actual embodiment, the thermally operated glow plug energization cycling control combination 30 is designed to provide a period of approximately 7.5 seconds to first cut off at an engine temperature of the order of −18° Celsius. That is, upon the initial application of operating potential, the normally closed contacts 33 and 34 thereof are operated electrically open after a period of approximately 7.5 seconds with an engine temperature of the order of −18° Celsius. Referring to FIG. 6, the time to first cut-off decreases substantially linearly with increases of engine temperature until an engine temperature of the order of +80° Celsius at which the engine may be cranked without glow plug heating. Consequently, while the engine temperature is of the order of +80° C., contacts 33 and 34 of the glow plug energization cycling control combination 30 are maintained open. Further, the pulse frequency at an engine temperature of the order of −18° Celsius is designed to be one cycle period per six seconds, a cycle period being equal to the sum of the time the glow plugs are energized plus the time the glow plugs are deenergized until the initiation of the next glow plug heating cycle. Referring again to FIG. 6, it is noted that the cycle period increases with increases of engine temperature until an engine temperature of the order of +55° Celsius after which a cycle period of approximately 26 seconds is sufficient. The duty cycle, the time of glow plug energization divided by the sum of the time of glow plug energization plus the time of glow plug deenergization until the initiation of the next glow plug heating cycle is designed to be approximately 23% at an engine temperature of the order of −18° Celsius. Referring to FIG. 6, the duty cycle decreases substantially linearly with increases of engine temperature up to an engine temperature of the order of +80° Celsius. In this regard, the glow plug heating power is determined by the duty cycle, the longer the duty cycle the greater the heating power.

Figure 7:
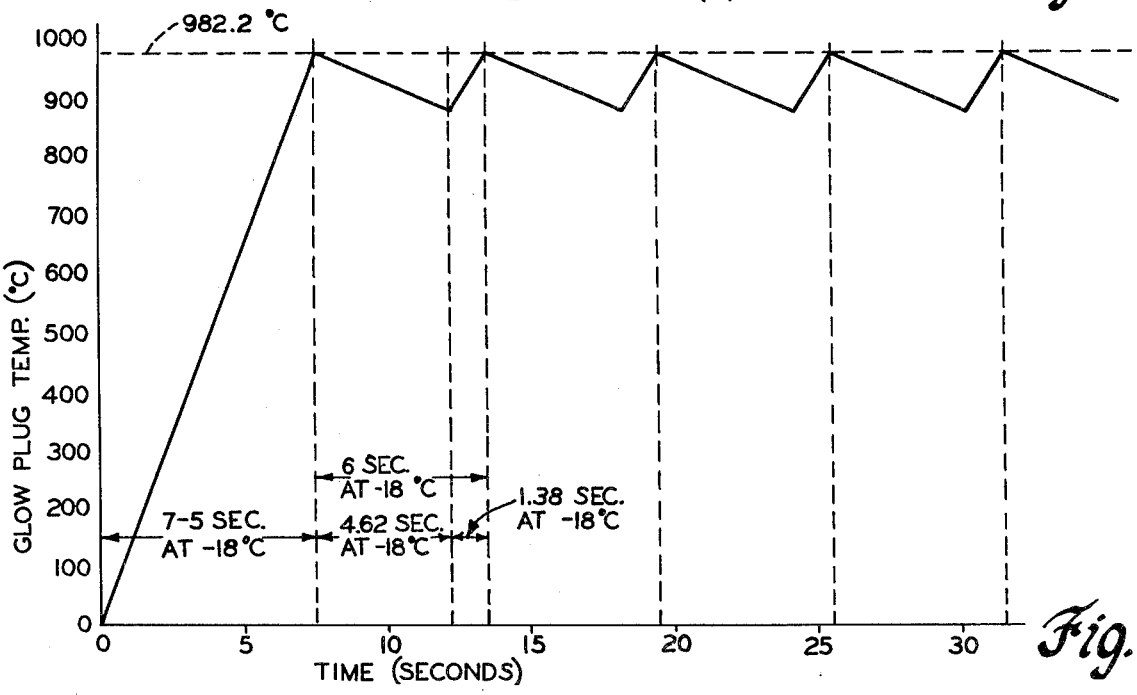
FIG. 7 is another set of curves also useful in understanding the operation of the circuit of FIG. 1.

Assuming that the engine temperature is −18° Celsius, the time to first cut-off, the time of initial energization of the glow plugs upon the application of supply potential, is 7.5 seconds and the cycle period is one cycle per six seconds, as has been previously brought out. Referring to FIG. 7, upon the application of supply potential, the glow plugs and heater element 31 are initially energized through circuitry previously explained for a period of 7.5 seconds, the time required for the glow plugs to heat to the maximum allowable temperature which will be assumed to be of the order of 900° Celsius. At the conclusion of the 7.5 second time period to first cut-off, normally closed contacts 33 and 34 of the thermally operated glow plug energization cycling control combination 30 are thermally operated open to interrupt the energizing circuit for operating coil 28 of power switching relay 25, as previously explained. Upon the interruption of this energizing circuit, movable contact 26 is operated out of engagement with stationary contact 27 to interrupt the previously described heater element 31 and glow plug energizing circuits and initiate a glow plug cooling cycle. At this time, the glow plugs and the thermally operated glow plug energization cycling control combination 30 begin to cool at a rate determined by the thermal time constant thereof. As the duty cycle at an engine temperature of −18° Celsius is approximately 23%, this glow plug cooling cycle continues for a period of 4.62 seconds, 77% of 6 seconds. At the termination of 4.62 seconds, contacts 33 and 34 of the thermally operated glow plug energization cycling control combination 30 operate closed to complete the energizing circuit for operating coil 28 of power switching relay 25. Upon the energization of operating coil 28, movable contact 26 is operated into electrical circuit closed engagement with stationary contact 27 to complete previously described heater element 31 and glow plug energizing circuits and initiate the next glow plug heating cycle. This heating cycle lasts for a period of 1.38 seconds, 23% of 6 seconds, until the glow plugs are again heated to the maximum allowable temperature, of the order of 900° Celsius. At this time, normally closed contacts 33 and 34 of the thermally operated glow plug energization cycling control combination 30 are thermally operated open to interrupt the energizing circuit for operating coil 28 of power switching relay 25. Upon the interruption of this energizing circuit, movable contact 26 is operated out of engagement with stationary contact 27 to interrupt the previously described heater element 31 and glow plug energizing circuits and initiate the next glow plug cooling cycle. This periodic cycling continues so long as the engine is not in the "Run" mode. In the actual embodiment, the thermally operated glow plug energization control combination 30 has designed therein a hysteresis factor that provides a glow plug temperature range of the order of 93° C. during the cycling period.

Significant desirable features of the circuit herein described are:

(1) Since the glow plug energization cycling control combination 30 is mounted in a location at which it is sensitive to the temperature of the engine, when the engine has reached operating temperature, thermally operated contacts 33 and 34 are operated open in response to engine heat. Therefore, the heater element 31 and glow plug energizing circuits are maintained open after engine "warm-up" even though it may not be in the "Run" mode;

(2) Since the heater element 31 and the glow plugs are energized by substantially the same potential, this circuit effects glow plug temperature control in the manner hereinabove described independent of operating potential; and (3) For a variety of reasons, the glow plug peak temperature and the glow plug lower cycling temperature are not the same as engine temperature is varied. A given engine temperature change will not produce a proportional change of glow plug temperature change over the high temperature range of the glow plug. This effect causes glow plug temperature rise to be progressively less as engine temperature increases. This effect, which is pronounced, is caused to some extent by the radiation heat loss component of the glow plugs (which varies as the fourth power of absolute temperature) and perhaps other effects. The result, I have found, is a net reduction in glow plug temperatures with increasing engine temperature that approximately matches the reduced engine requirement for glow plug aid at increasing engine temperatures. Consequently, the glow plug duty and energy requirements are not substantially greater than required for engine start and early run at each particular engine starting temperature.

In summary, the opening and closing of switch contacts 33 and 34 of control combination 30 controls the average power supplied to the glow plugs as a function of engine temperature. Since the glow plugs exhibit a decreased temperature rise per unit change of average input heating power when the temperature of the glow plug reaches a mixture igniting temperature of the order of 900° C., the rate of change of temperature of the glow plug is reduced as compared to a change in power level dictated by control combination 30. The opening temperature of bimetal 32 is selected to correspond to a self igniting temperature range of the engine, for example in the order of 80° C. The heating rate of the bimetal 32 is such that the glow plugs reach the mixture igniting temperature in the range of 900° C. at the same time that the temperature of bimetal 32 reaches the self-igniting temperature of the engine, for example 80° C., when engine temperature is of the order of −18° C. During the cyclical glow plug energization and deenergization, the highest glow plug temperature is controlled to a level less than that at which glow plug destruction will occur.

To facilitate the description of the combination of this invention specific temperatures and temperature ranges have been set forth in the specification. It is to be specifically understood that these temperatures and temperature ranges are orders of magnitude only as each different application may require different specific values. For example, the mixture igniting temperature range may be within a temperature range of 850° C. to 980° C.

While a preferred embodiment of the present invention has been shown and described, it will be obvious to those skilled in the art that various modifications and substitutions may be made without departing from the spirit of the invention which is to be limited only within the scope of the appended claims.

The embodiments of the invention in which an exclusive property or privilege is claimed are defined as follows:

1. In combination:

a Diesel engine having at least one glow plug having a resistance element heatable to a mixture-igniting temperature range of the order of 900° C. to facilitate engine starting under cold conditions, the glow plug being characterized by decreased temperature rise per unit of heating power while the temperature thereof is within said mixture-igniting temperature range and the engine being capable of starting without significant glow plug action at a predetermined self-igniting temperature of the order of 80° C.;

a thermostatic switch adapted to complete an electric circuit when below said self-igniting temperature and to interrupt the circuit when above said self-igniting temperature;

means to energize said glow plug when said switch completes the electric circuit and to deenergize said glow plug when said switch interrupts the electric circuit;

resistive heater means energized when said glow plug is energized to heat said switch in accordance with current flow supplied said heater means at a rate such that at a predetermined low engine starting temperature of the order of −18° C. said glow plug reaches said mixture-igniting temperature range at the time said switch reaches said self-igniting temperature; and means communicating the engine temperature to said thermostatic switch independently of the said last means so that said switch partakes of the engine temperature and interrupts said circuit in the absence of heating by said last means when the engine temperature is at or above said self-igniting temperature, said combination being so constructed and arranged that over a substantial engine temperature range between said predetermined low engine starting temperature and said self-igniting temperature said glow plug is heated above the temperature required to assist engine start.

2. In combination:

a Diesel engine having at least one glow plug having a resistance element heatable to a mixture-igniting temperature range of the order of 900° C. to facilitate engine starting under cold conditions, the glow plug being characterized by decreased temperature rise per unit of heating power while the temperature thereof is within said mixture-igniting temperature range and the engine being capable of starting without significant glow plug action at a predetermined self-igniting temperature of the order of 80° C.;

a thermostatic switch adapted to complete an electric circuit when below said self-igniting temperature and to interrupt the circuit when above said self-igniting temperature;

means to energize said glow plug when said switch completes the electric circuit and to deenergize said glow plug when said switch interrupts the electric circuit;

resistive heater means energized when said glow plug is energized to heat said switch in accordance with current flow supplied said heater means at a rate such that at a predetermined low engine starting temperature of the order of −18° C. said glow plug reaches said mixture-igniting temperature range at the time said switch reaches said self-igniting temperature; and means communicating the engine temperature to said thermostatic switch independently of the said last means so that said switch partakes of the engine temperature and interrupts said circuit in the absence of heating by said last means when the engine temperature is at or above said self-igniting temperature, said combination being so constructed and arranged that said switch and glow plugs are energized for a period of time greater than required for said glow plug temperature to reach said mixture-igniting temperature range so as to cycle said glow plug temperature substantially within said mixture-igniting temperature range whereby, over a substantial engine temperature range between said predetermined low engine starting temperature and said self-igniting temperature, said glow plug is heated above the temperature required to assist engine start.

3. In combination:

a Diesel engine having at least one glow plug having a resistance element heatable to a mixture-igniting temperature range of the order of 900° C. to facilitate engine starting under cold conditions, the glow plug being characterized by decreased temperature rise per unit of heating power while the temperature thereof is within said mixture-igniting temperature range and the engine being capable of starting without significant glow plug action at a predetermined self-igniting temperature of the order of 80° C.;

means defining a housing mounted on the engine and containing a thermostatic switch adapted to complete an electric circuit when below said self-igniting temperature and to interrupt the circuit when above said self-igniting temperature, said switch having a temperature responsive element so mounted that it partakes of engine temperature;

means to energize said glow plug when said switch completes the electric circuit and to deenergize said glow plug when said switch interrupts the electric circuit; and resistive heater means energized when said glow plug is energized to heat said switch in accordance with current flow supplied said heater means at a rate such that at a predetermined low engine starting temperature of the order of −18° C. said glow plug reaches said mixture-igniting temperature range at the time said switch reaches said self-igniting temperature, the thermal communication between said temperature responsive element and said engine being such that in the absence of energization of said heater means said switch interrupts said circuit when engine temperature is at or above said self-igniting temperature and said combination being so constructed and arranged that over a substantial engine temperature range between said predetermined low engine starting temperature and said self-igniting temperature said glow plug is heated above the temperature required to assist engine start.

4. A Diesel engine glow plug energization control combination for use with Diesel engines having at least one electrically energizable glow plug and being capable of controlling glow plug energization across an operating potential source, comprising: an electrically controllable electrical switching device effective to complete and interrupt a glow plug energizing circuit when operated electrically closed and open, respectively; and a glow plug energization cycling means including in combination an electrically energized heater element connected in an energizing circuit controlled by said electrical switching device and a bimetal element located in heat transfer relationship with said heater element and said engine and arranged to effect the operation of said electrical switching device electrically closed upon the application of operating potential to complete said glow plug and heater element energizing circuits for a predetermined period of time as determined by heater element and engine temperature and, thereafter, to effect the operation of said electrical switching device alternately electrically open and closed at a duty cycle that decreases with increasing engine temperature and vice versa whereby, upon the application of operating potential, said glow plug and heater element energizing circuits are initially completed for said predetermined period of time and, thereafter, are cyclically interrupted and completed with a duty cycle that decreases with increases of engine temperature and vice versa, said glow plug being characterized by reduced temperature rise per unit of input heating power when the temperature thereof is above a predetermined value sufficient to provide engine compression ignition whereby the amount of temperature change of said glow plug for a given change of input heating power is reduced when glow plug temperature is at said predetermined value said input heating power being a function of duty cycle, said bimetal operative to cause said switching device to deenergize said glow plug when the bimetal is at a temperature of the order of 80° C.

5. A Diesel engine glow plug energization control combination for use with Diesel engines having at least one electrically energizable glow plug and being capable of controlling glow plug energization across an operating potential source, comprising: an electrically controllable electrical switching device effective to complete and interrupt a glow plug energizing circuit when operated electrically closed and open, respectively; a glow plug energization cycling means including in combination an electrically energized heater element connected in an energizing circuit controlled by said electrical switching device and a bimetal element located in heat transfer relationship with said heater element and said engine and arranged to effect the operation of said electrical switching device electrically closed upon the application of operating potential to complete said glow plug and heater element energizing circuits for a period of time as determined by heater element and engine temperature and, thereafter, to effect the operation of said electrical switching device alternately electrically open and closed at a duty cycle that decreases with increasing engine temperature and vice versa whereby, upon the application of operating potential, said glow plug and heater element energizing circuits are initially completed for said predetermined period of time and, thereafter, are cyclically interrupted and completed with a duty cycle that decreases with increases of engine temperature and vice versa, said glow plug being characterized by reduced temperature rise per unit of input heating power when the temperature thereof is above a predetermined value sufficient to provide engine compression ignition whereby the amount of temperature change of said glow plug for a given change of input heating power is reduced when glow plug temperature is at said predetermined value, said input heating power being a function of duty cycle, said bimetal operative to cause said switching device to deenergize said glow plug when the bimetal is at a temperature of the order of 80° C., and means responsive to said engine being in the "Run" mode for effecting the operation of said electrical switching device electrically open and to maintain said electrical switching device electrically open while said engine is in the "Run" mode.

6. A Diesel engine glow plug energization control combination for use with Diesel engines having at least one electrically energizable glow plug and being capable of controlling glow plug energization across an operating potential source, comprising:

an electrically controllable electrical switching device effective to complete and interrupt a glow plug energizing circuit when operated electrically closed and open, respectively, a glow plug energization cycling means including in combination an electrically energized heater element connected in energizing circuit controlled by said electrical switching device and a bimetal element located in heat transfer relationship with said heater element and said engine arranged to effect the operation of said electrical switching device electrically closed upon the application of operating potential to complete said glow plug and heater element energizing circuits for a period of time as determined by heater and engine temperature and, thereafter, to effect the operation of said electrical switching device alternately electrically open and closed, said cycling means being so constructed and arranged that the duty cycle and duty cycle frequency both decrease with increasing engine temperature whereby the average power supplied to said glow plug varies inversely with engine temperature so as to provide a glow plug temperature that is sufficient to aid in compression ignition of the combustible mixture supplied to the engine, said bimetal operative to cause said switching means to deenergize said glow plug when the bimetal is at a temperature of the order of 80° C., and means energizable by an operating potential source for effecting the operation of said electrical switching device electrically open at the conclusion of a second predetermined period of time longer than said first predetermined period of time and for maintaining said electrical switching device electrically open until operating potential is removed therefrom.

7. A Diesel engine glow plug energization control circuit for use with Diesel engines having at least one electrically energizable glow plug and being capable of controlling glow plug energization across an operating potential source, comprising: an electrically controllable electrical switching device effective to complete and interrupt a glow plug energizing circuit when operated electrically closed and open, respectively; a glow plug energization cycling means including in combination an electrically energized heater element connected in an energizing circuit controlled by said electrical switching device and a bimetal element located in heat transfer relationship with said heater element and arranged to effect the operation of said electrical switching device electrically closed upon the application of operating potential to complete said glow plug and heater element energizing circuits for a first predetermined period of time as determined by engine temperature and, thereafter, to effect the operation of said electrical switching device alternately electrically open and closed at a predetermined cycle period as determined by engine temperature whereby, upon the application of operating potential, said glow plug and heater element energizing circuits are initially completed for said first predetermined period of time and, thereafter, are cyclically interrupted and completed at a frequency determined by engine temperature; means responsive to said engine being in the "Run" mode for effecting the operation of said electrical switching device electrically open and to maintain said electrical switching device electrically open while said engine is in the "Run" mode; and means energizable by an operating potential source for effecting the operation of said electrical switching device electrically open at the conclusion of a second predetermined period of time longer than said first predetermined period of time and for maintaining said electrical switching device electrically open until operating potential is removed therefrom.

8. In combination:

a Diesel engine having at least one electrically energizable glow plug, the glow plug being subjected to overtemperature destruction when it is connected to a voltage source for longer than a predetermined time period and exhibits a reduced increase in temperature for a unit increase in input power to the glow plug when glow plug temperature exceeds a predetermined value;

cycling means comprising a thermostatic switch having an electric heater element and a bimetal element in heat transfer relationship with both said electric heater element and said engine whereby said bimetal element responds to electric heater element temperature and engine temperature and is effective when energized to alternately connect and disconnect said glow plug and said electric heater element to and from a source of voltage in order to control the times of power supply to said glow plug;

said switch opening when said bimetal element reaches a switch opening temperature that is the engine temperature wherein glow plug energization is not required for engine start and recloses when said bimetal element temperature drops a predetermined amount;

the time period that said switch is closed defining the duty cycle of energization of said glow plug;

the power input to said glow plug being a function of said duty cycle which varies inversely with change in engine temperature;

said switch opening temperature being such that the switch opens during engine start under cold conditions such as −18° C. when the glow plug reaches an engine start temperature below the overtemperature destruction range of the glow plug to provide sufficient glow plug temperature to aid engine start and said switch opening temperature being chosen so that the glow plug temperature remains substantially within the engine start values.

* * * * *

UNITED STATES PATENT AND TRADEMARK OFFICE

CERTIFICATE OF CORRECTION

PATENT NO. : 4,177,785

DATED : December 11, 1979

INVENTOR(S) : Arthur R. Sundeen

It is certified that error appears in the above-identified patent and that said Letters Patent are hereby corrected as shown below:

Column 2, line 5, after "one" change "of" to -- or --.

Column 6, line 22, "heater" should read -- heat --.

Column 7, line 35, "plugss" should read -- plugs --.

Column 8, line 12, "operation" should read -- operating --.

Column 10, line 7, after "element" insert -- 41 --.

Column 12, line 40, "effects" should read -- affects --.

Signed and Sealed this

*Twenty-second* Day of *April 1980*

[SEAL]

*Attest:*

SIDNEY A. DIAMOND

*Attesting Officer*

*Commissioner of Patents and Trademarks*